US006059669A

United States Patent [19]

Pearce

[11] Patent Number: 6,059,669

[45] Date of Patent: May 9, 2000

[54] GOLF CLUB HEAD HAVING PERFORMANCE-ENHANCING STRUCTURE

[75] Inventor: Tony M. Pearce, Alpine, Utah

[73] Assignee: EdiZone, LC, Pleasant Grove, Utah

[21] Appl. No.: 09/072,735

[22] Filed: May 4, 1998

[51] Int. Cl.[7] ..... A63B 53/04

[52] U.S. Cl. ..... 473/339; 473/346; 473/349; 273/DIG. 14

[58] Field of Search ..... 473/324, 327, 473/332, 349, 339, 345, 346, 333, 334, 335, 336, 337, 338, 350; 273/DIG. 14

[56] References Cited

U.S. PATENT DOCUMENTS

| | | |
|---|---|---|
| 1,592,463 | 7/1926 | Marker . |
| 1,658,581 | 2/1928 | Tobia . |
| 1,854,548 | 4/1932 | Hunt . |
| 1,864,513 | 6/1932 | Balch . |
| 2,067,556 | 1/1937 | Wettlaufer . |
| 2,171,383 | 8/1939 | Wettlaufer . |
| 2,460,435 | 2/1949 | Schaffer . |
| 3,468,544 | 9/1969 | Antonious . |
| 3,547,445 | 12/1970 | Hardesty . |
| 3,556,532 | 1/1971 | Ballmer . |
| 4,204,684 | 5/1980 | Molitor . |
| 4,535,990 | 8/1985 | Yamada . |
| 4,614,627 | 9/1986 | Curtis . |
| 4,630,826 | 12/1986 | Nishigaki et al. . |
| 4,650,626 | 3/1987 | Kurokawa . |
| 4,664,383 | 5/1987 | Aizawa . |
| 4,681,321 | 7/1987 | Chen . |
| 4,687,205 | 8/1987 | Tominaga et al. . |
| 4,754,975 | 7/1988 | Aizawa . |
| 4,793,615 | 12/1988 | Fernandez . |
| 4,811,949 | 3/1989 | Kobayashi . |
| 4,883,623 | 11/1989 | Nogamoto et al. . |
| 4,944,515 | 7/1990 | Shearer . |
| 5,000,454 | 3/1991 | Soda . |
| 5,007,643 | 4/1991 | Okumoto et al. . |
| 5,009,425 | 4/1991 | Okumoto et al. . |
| 5,056,705 | 10/1991 | Wakita et al. . |
| 5,060,951 | 10/1991 | Allen . |
| 5,067,715 | 11/1991 | Schmidt et al. . |
| 5,100,144 | 3/1992 | Okumoto et al. . |
| 5,154,425 | 10/1992 | Niskanen et al. . |
| 5,176,383 | 1/1993 | Duclos . |
| 5,346,217 | 9/1994 | Tsuchiya et al. . |
| 5,429,365 | 7/1995 | McKeighen . |
| 5,445,382 | 8/1995 | Pearce et al. . |
| 5,460,377 | 10/1995 | Schmidt . |
| 5,467,989 | 11/1995 | Good et al. . |
| 5,586,948 | 12/1996 | Mick . |
| 5,624,331 | 4/1997 | Lo . |
| 5,803,830 | 9/1998 | Austin . |

*Primary Examiner*—Sebastiano Passaniti
*Attorney, Agent, or Firm*—Daniel McCarthy; Brick G. Power

[57] ABSTRACT

A golf club that is preferably made from fiber-reinforced plastic composite by an injection molding process. The preferred golf club head includes a striking face for striking a golf ball, an outer periphery, a cavity formed between the outer periphery and the back of the striking face, a sole enclosing the bottom portion of said cavity, and at least one elongate power bar extending across the cavity from the striking face to the outer periphery. The sole is preferably integrally formed with the face plate and outer periphery. The cavity of the golf club head opens to the top of the club head. Each elongate power bar separates the cavity into receptacles. Inserts may be placed within the receptacles for aesthetic, aerodynamic, acoustic, and other purposes.

22 Claims, 4 Drawing Sheets

GOLF CLUB HEAD HAVING PERFORMANCE-ENHANCING STRUCTURE

I. BACKGROUND OF THE INVENTION

A. Field of the Invention

This invention relates to the field of golf club heads and methods for their manufacture. More particularly, the invention relates to fiber reinforced plastic golf club heads, golf club heads that are made by injection molding, golf club heads that include structural features to optimize the distance a golf ball may be propelled, golf club heads that have a large preferred striking surface or "sweet spot", golf heads that absorb vibrational forces rather than transferring them to the hands and arms of the user, golf club heads that have structural features to stabilize the club when striking a ball, and golf club heads that include weight adjustability features.

B. The Background Art

Prior to the invention, golf club heads were typically divided into groups called "woods" and "irons" based on the type of material from which they were made. Woods were typically used when it was desired to propel a golf ball a long distance and irons were used to propel a golf ball a shorter distance. Many different golf club head designs have been tried in the prior art, with most emphasis being placed on propelling the golf ball the greatest possible distance. Typically, woods were made of a cellulose material and had a metal sole plate for weight, balance and durability.

1. Golf Club Heads with Cavities

In the prior art, there are several golf club heads that have cavities for different purposes, and related features. In U.S. Pat. No. 3,556,532, issued in the name of James E. Ballmer, a golf head is disclosed that was formed from a body and included a number of cavities in the body. The cavities provided the golf club head with acoustical qualities upon striking a golf ball. This design allowed a golf club head to be made from a non-cellulose material, such as plastic, with sound qualities that emulate the sharp, high frequency sound of a traditional wood striking a golf ball. However, the '532 patent illustrates and claims only cavities which are formed in the bottom of the club head.

In U.S. Pat. No. 5,445,382, issued in the names of Terry V. Pearce and Tony M. Pearce, a golf club head is disclosed which is made from injection molded long fiber reinforced plastic where the fibers are entangled with each other for increased stiffness. That patent also discloses a structure that includes cavities in the bottom of the golf club head, the cavities being covered by a sole plate in the assembled club head.

U.S. Pat. No. 5,346,217, issued in the names of Kazuhiro Tsuchiya, Toshiharu Hoshi, Atsushi Tsuchida, and Kenzaburo Iijima, discloses a metal alloy golf club head with a hollow interior. U.S. Pat. No. 5,060,951, issued in the name of Dillis V. Allen, discloses an enlarged face golf club head made from a thick-walled metallic material and having cavities in a honeycomb pattern behind the striking face. U.S. Pat. No. 5,067,715, issued in the names of Glenn H. Schmidt, John P. Sheehan, and Richard C. Helmstetter, discloses a metal golf club head that has shock wave distributing dendrites within its interior. U.S. Pat. No. 3,468,544, issued in the name of Anthony J. Antonious, discloses an aerodynamic golf club head having passages through which air may flow when the head is swung at a golf ball. The passages open at one end through the top of the striking face and at the other through the opposite side at a lower position. U.S. Pat. No. 2,460,435, issued in the name of Fred B. Schaffer, discloses a golf club head that includes a plurality of voids that are preferably arranged radial to the core with separating ribs, the arrangement of voids and ribs being such that strength and stress transmission are achieved. U.S. Pat. No. 1,592,463, issued in the name of Theodore Marker, discloses a metallic golf club head with internal webs to connect the striking face of the head with the rear wall of the head. U.S. Pat. No. 4,630,826, issued in the names of Susumu Nishigaki, Akio Ohkoshi and Torao Aozuka, discloses a golf club head that includes ceramic plates and laminated layers of fiber with an internal cavity.

None of the above-identified patents disclose the presence of a golf club having cavities which are open to the top of the club. Nor do any of those patents disclose a golf club head having an integrally formed sole plate. Thus, manufacture of the prior art golf club heads with cavities requires assembly of at least a club head and a sole plate. Further labor may also be required in finishing the assembled portions of the club head to provide it with an aesthetically pleasing appearance.

2. Golf Club Heads Including Inserts and Attachments

Also in the background art, there were various golf club heads that included inserts and attachments of various types. For example, U.S. Pat. No. 2,067,556, issued in the name of William L. Wetlaufer, discloses an adjustable golf club with complex sole plate attachment features. In U.S. Pat. No. 3,457,445, issued in the name of Benjamin T. Hardesty, a golf club head is disclosed that is made from plastic and has a separate faceplate. A plug is provided to secure the faceplate in position. In U.S. Pat. No. 4,687,205, issued in the names of Ichiro Tominaga and Teruo Sasaki, a golf club head is disclosed that includes a composite head of resin and fibers and heavy metal inserts. The '205 patent describes embedding of the heavy metal inserts within the club head to provide additional weight thereto. U.S. Pat. No. 5,467,989, issued in the names of Robert Good and Richard Carobus, discloses a golf club head made from a solid, unitary mass of acrylic with a metal insert. The metal insert of the '989 patent holds the club shaft in place on the club head.

The use of a separate face plate, as disclosed in the above patents, increases the manufacturing, materials, and finishing costs of those golf club heads. Further, none of these patents disclose a feature which allows for varying the weight of the club or weighting located along the arc of a normal golf swing.

3. Golf Club Heads Made From Various Non-Typical Materials

In U.S. Pat. No. 4,204,684, which issued in the name of Robert P. Molitor, a golf club head and related production method are described where laminated resinous or plastic materials were bonded together to form a composite head. Some layers of the head had different characteristics than others to provide a dimensionally stable and durable golf club head with high impact resistance and approximately the same density of a wooden golf club head.

U.S. Pat. No. 5,007,643, issued in the names of Takahuru Okumoto, Tatsuo Nishimoto and Hideaki Wakaki, discloses a golf club head that uses an outer shell made of a fiber-reinforced resin and a core made of a syntactic foam, the core having both resin with glass microballoons and whiskers therein. U.S. Pat. No. 5,009,425, which issued in the names of Takahuru Okumoto, Toshio Ninomya and Tstsuya Hayashi, describes a golf club head with an outer shell made from fiber-reinforced resin and a core within the outer shell, the core being made from a high specific gravity metal powder within a thermoplastic resin. The core may include reinforcing fibers.

In U.S. Pat. No. 1,854,548, issued in the name of James B. Hunt, a golf club head is disclosed made from spring metal. In U.S. Pat. No. 4,883,623, issued in the names of Itsushi Nagamoto, Tatsuo Nakanishi and Tomoharu Yamashita, a method for making a golf club head from fibrous material is disclosed. In U.S. Pat. No. 5,056,705, issued in the names of Saburo Wakita, Junji Hoshi, Shinich Miyamoto and Hideo Kawabata, a method for making a golf club head from a precision cast metal such as titanium or an alloy is disclosed. In U.S. Pat. No. 1,864,513, issued in the name of Jack H. Balch, a golf club head made from layers or plies of an appropriate fabric such as duck canvas is disclosed. U.S. Pat. No. 4,664,383, issued in the name of Yuichi Aizawa, discloses a golf club head that includes resin with woven and non-oriented fibers. U.S. Pat. No. 5,154,425, issued in the names of Paul W. Niskanen, Danny R. White, March G. Mortensen and Stanislav Antolin, discloses a golf club head which is made from metal matrix composite and/or ceramic matrix composite materials. U.S. Pat. No. 5,100,144, issued in the names of Takahuru Okumoto and Tetsuo Hayashi, discloses a golf club head made from a fiber-reinforced resin. U.S. Pat. No. 4,793,616, issued in the name of David Fernandez, discloses a golf club head which includes a composite material molded to a hard, high density material. U.S. Pat. No. 4,754,975, issued in the name of Yuichi Aizawa, discloses a golf club head which includes an inner layer of non-metallic fiber reinforced synthetic resin. U.S. Pat. No. 4,650,626, issued in the name of Ikuji Kurokawa, discloses a method for making a golf club head, the method including the step of heat pressing a compound in a mold.

Many of the materials described and manufacturing processes used and/or disclosed in the above patents disclosed above are costly. None include cavities which open to the top of the club or a mechanism which imparts the club with weight variability along the arc of a normal golf swing.

Each of the documents disclosed above is hereby incorporated by reference in its entirety for the material disclosed therein.

What is needed is a durable golf club head that is economical to produce. A low-cost, light weight golf club head is needed which optimizes the distance a golf ball may be propelled. Further, a golf club head is needed with the above advantages and which has a large preferred striking surface or "sweet spot". A golf club head which absorbs vibrational forces is also needed. Further needs include weight/momentum adjustability and improved structural stability.

II. SUMMARY OF THE INVENTION

It is an object of the invention to provide a long-lasting and durable golf club head that is economical to produce. It is a feature of the invention that a fiber-reinforced plastic golf club head of appropriate structural shape is made by an injection molding process. It is a consequent advantage of the invention that every thirty to sixty seconds, an injection molding machine can run through one production cycle producing one to four or more heads per cycle, the heads being in substantially finished form and requiring no sanding, installation of sole plate or face plate, or painting, unless desired. This is an economical and labor-efficient way to provide a premium golf club head. In order to make golf club heads by this desired method, a golf club head of appropriate structure has been designed as disclosed herein.

It is an object of the invention to provide a golf club head that optimizes the distance a golf ball may be propelled. It is a feature of the invention that one or more power bars are situated between a striking face and an outer periphery in order to minimize head distortion at ball strike and impart the maximum possible potential energy to the golf ball. It is also a feature of the invention that the outer periphery of the head is of similar structural integrity to the power bars and striking face in order to preserve head integrity and transfer energy to a golf ball. It is an advantage of the invention that this provides superior ball flight distance.

It is an object of the invention to provide a golf club head that has a large preferred striking surface or "sweet spot". It is a feature of the invention that a carbon fiber golf head is provided that utilizes an outer periphery, striking face and power bars arranged in a manner that minimizes head distortion when striking a golf ball. It is also a feature of the invention that selectable weights are insertable into the head behind the sweet spot along the arc that the sweet spot travels during a swing and at the point on the outer periphery which is furthest from the sweet spot. The result is a head that minimizes the tendency to twist, turn or distort during ball strike even if the ball does not contact the center of the sweet spot. This provides the consequent advantage that the club head is tolerant of off-center contact with a ball while still providing a comparatively straight and true ball flight.

It is an object of the invention to provide a golf club head that absorbs vibrational forces rather than transferring them to the hands and arms of the user. It is a feature of the invention that fiber reinforced plastic is used to construct the golf club head, and it is an inherent feature of fiber-reinforced plastic material that it provides excellent shock and vibration absorption. It is an advantage of the invention that the golf club head both minimizes distortion at ball strike and minimizes transfer of shock and vibration to the user.

It is an object of the invention to provide a golf head that has structural features that stabilize the head and golf club when striking a ball. It is a feature of the invention that the preferred composite golf head utilizes power bars radiating from the face, preferably near the sweet spot and braced against the outer periphery. It is also a feature of the invention that the outer periphery may include insertable weights at a point on the periphery that is both furthest from the sweet spot on the striking face and directly behind the striking face along the arc through which the head is swung in striking a ball. It is a consequent advantage of the invention that the club head does not tend to twist or distort when striking a ball. It is a consequent advantage of the invention that the golf head is more forgiving to off-center contact with a golf ball, still tending to propel the ball in a direction tangential the arc of the user's swing. It is a consequent advantage of the invention that the insertable weight, which is directly behind the center of ball strike, transfers more distortion to the ball, thus increasing ball flight distance over that of clubs having heel-toe weights, which would cause face flex and transfer less distortion to the ball.

It is an object of the invention to provide a golf club head which is weight adjustable according to the preferences of the user. The preferred golf club head includes insertable weights that can be used to tailor the weight of the club head as desired. It is a consequent advantage of the invention that a single golf club head can accommodate the needs of many different users, thereby reducing manufacturing and inventory carrying costs.

Further objects, features and advantages of the invention will become apparent to persons of ordinary skill in the art upon reading the specification and appended drawings.

III. BRIEF DESCRIPTION OF THE DRAWINGS

IV. DETAILED DESCRIPTION OF THE PREFERRED EMBODIMENTS

A. Golf Club Head

Figure 1:
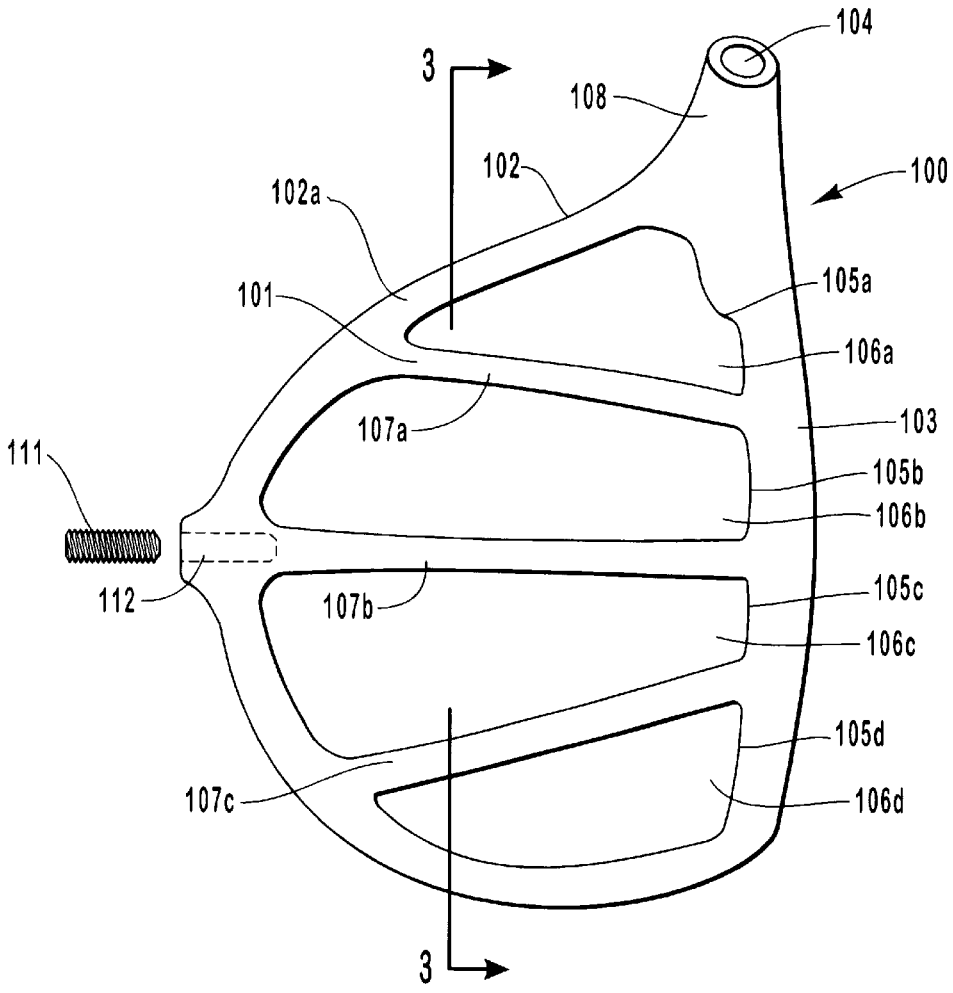
FIG. 1 depicts a top view of one preferred embodiment of the invented golf club head.
Figure 2:
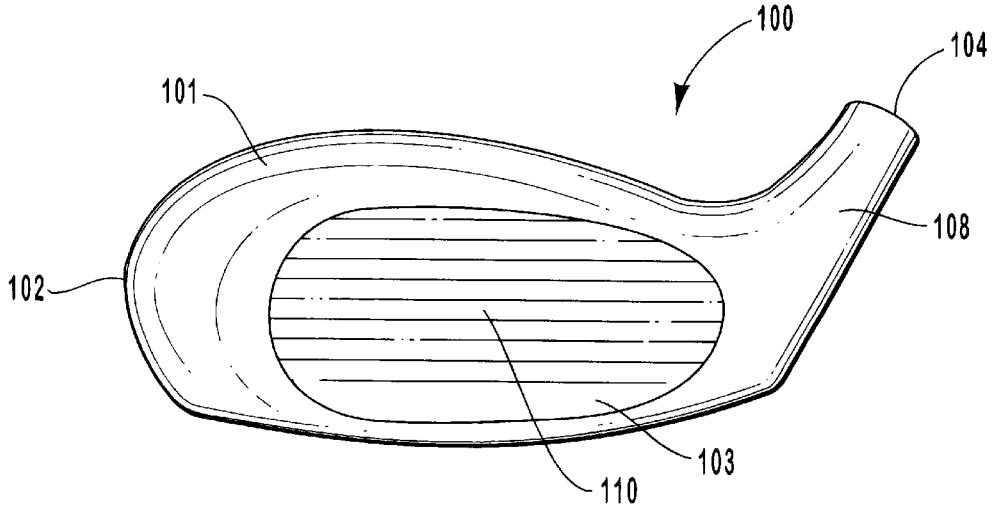
FIG. 2 depicts a front view (striking face side) of one preferred embodiment of the invented golf club head.

Referring to FIGS. 1–5, a top view (FIG. 1), a front view from the striking face side (FIG. 2), a cross sectional view at 3—3 of FIG. 1 (FIG. 3), a perspective view (FIG. 4) and a parts explosion view (FIG. 5) of one preferred embodiment of the invented golf club head are shown. The head 100 includes a body 101 that is formed into a geometry of general configuration that has come to be expected in a "wood". The body includes a curvilinear outer periphery 102 and a striking face 103. The outer periphery 102 has an outer periphery wall 102*a* that is of a thickness and dimension which, in combination with the power bar (described below), provides stiffness and structural integrity to the golf club head so that it is not distorted during use or storage and so that it can withstand the significant forces and strain to which it is exposed during use. The striking face 103 is of a size and angular orientation appropriate for striking a golf ball.

The body 101 also includes a shaft receptacle, also referred to as shaft attachment mechanism 104, in a golf club head neck 108 into which a golf club shaft with handle may be installed. Golf club shafts which are known in the art are insertable into shaft receptacle 104 and retained therein by any of a variety of mechanisms that are known to those of ordinary skill in the art.

Figure 3:
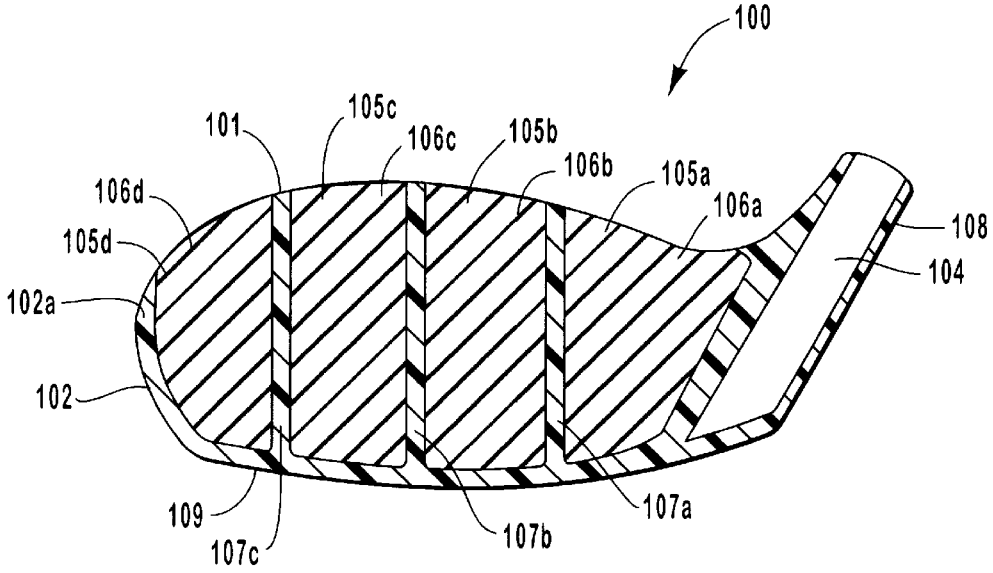
FIG. 3 depicts a cross-sectional view at line 3—3 of FIG. 1.
Figure 4:
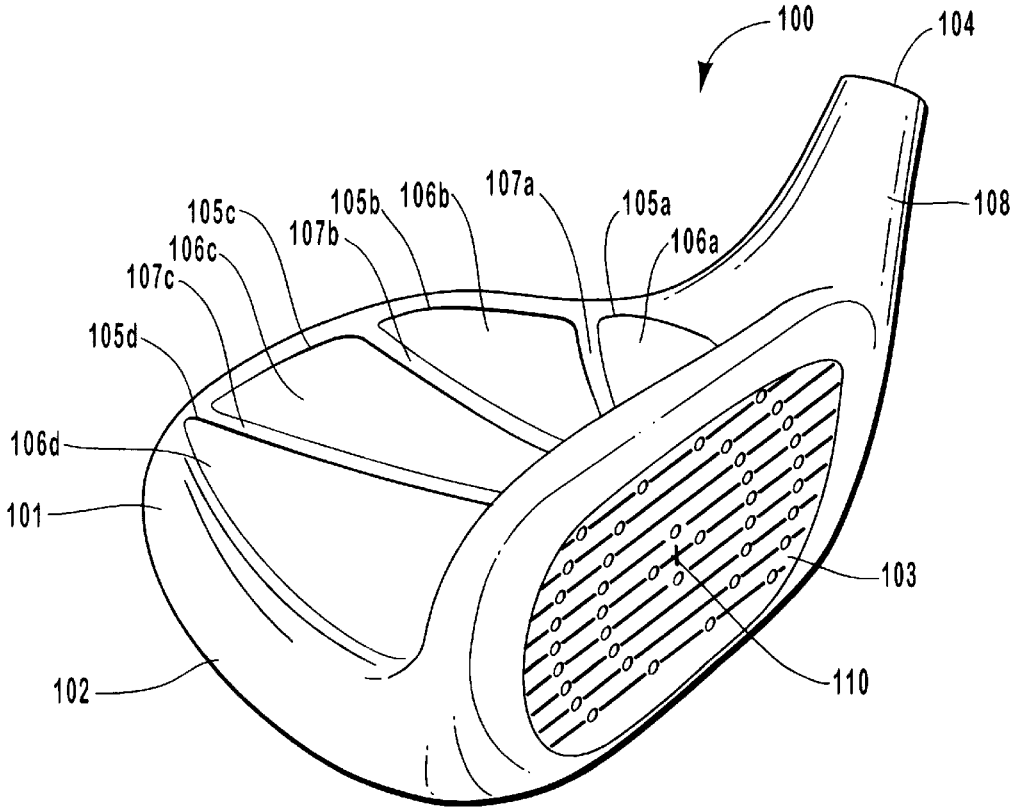
FIG. 4 depicts a perspective view of one preferred embodiment of the invented golf club head.
Figure 5:
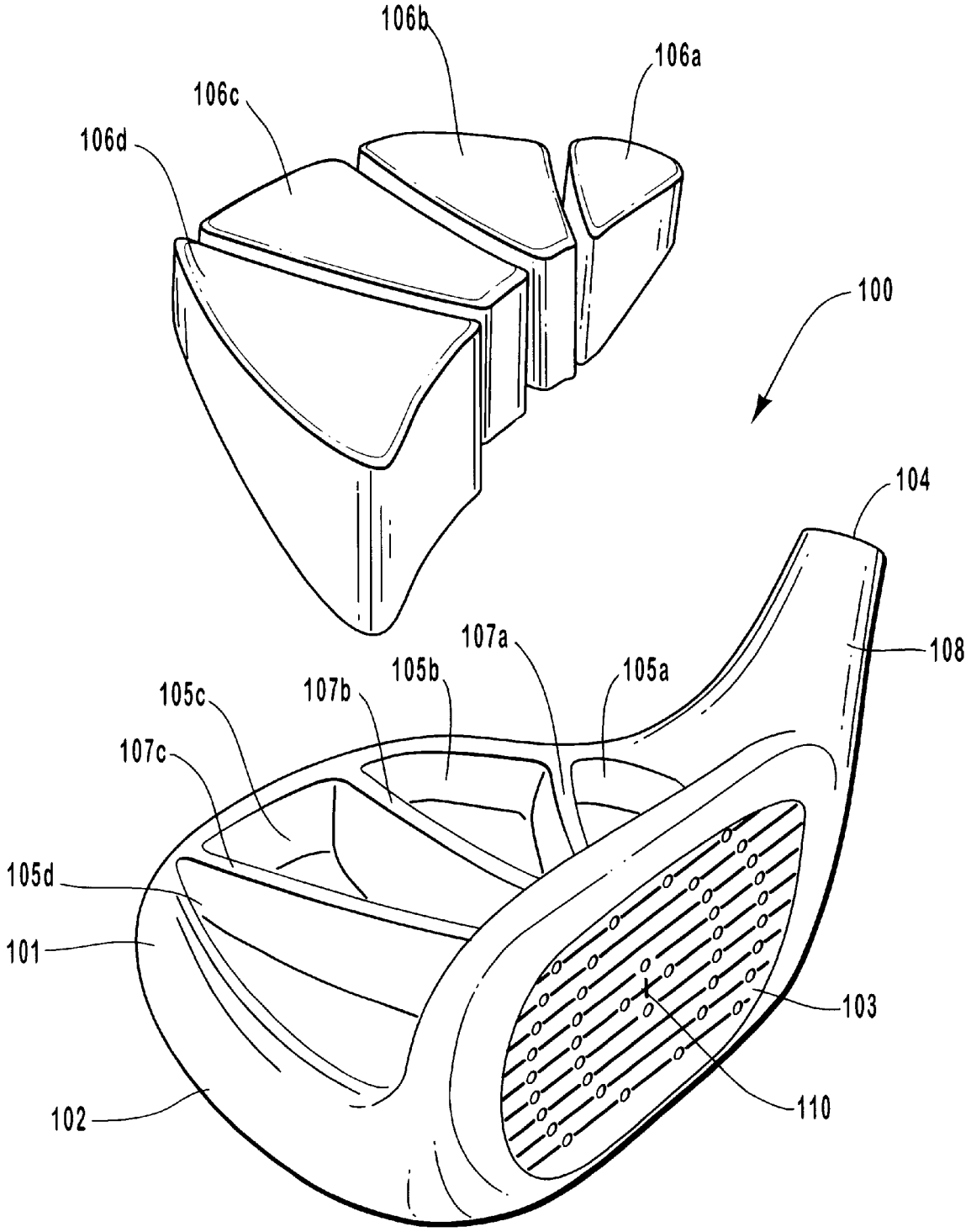
FIG. 5 depicts an exploded view of one preferred embodiment of the invented golf club head.

FIGS. 1, 3 and 4 illustrate the use of three (3) power bars 107*a*, 107*b* and 107*c* in the preferred embodiment of the golf club head of the invention. The power bars 107*a*–*c* stiffen the striking face 103 to ensure that impact energy from striking a golf ball is channeled into deforming the golf ball in order to maximize the ball's potential energy and optimize its travel distance, rather than permitting the body 101 to deform and thereby absorb energy that would be better used in propelling the ball. The preferred power bars 107*a*–*c* are joined to the outer periphery 102 and its wall 102*a* so that a rigid structure is obtained. Preferably, the power bars 107*a*–*c* also join with the sole 109. Thus, the striking face 103, power bars 107*a*–*c*, sole 109 and outer periphery 102 are preferably formed as a unitary golf club head, having an integral structure of injection molded fiber-reinforced plastic. The result of this design feature is greater flight distance of the ball. The outer periphery 102 structure adds to the function of the power bars 107*a*–*c* and assists in achieving this objective, and the combination of power bars and outer periphery brace the overall club head against distortion in order to ensure transfer of the maximum possible energy to the golf ball. Note that the preferred power bars 107*a*–*c* radiate generally away from and outwardly from the sweet spot center 110 on the striking face 103, although another configuration, as well as the use of a different number of power bars, could be chosen as well. The power bars 107*a*–*c*, outer periphery wall 102*a* and sole 109 serve as walls or divisions to form the receptacles 105*a*, 105*b*, 105*c* and 105*d*.

Four (4) receptacles 105*a*, 105*b*, 105*c* and 105*d* are shown. As desired, in the finished golf club head 100, the receptacles 105*a*–*d* may be left open, may contain a logo, design, or other aesthetic features therein, or may be used to receive inserts 106*a*, 106*b*, 106*c* and 106*d*. Preferably, the inserts 106*a*–*d* are thin members which cover the receptacles 105*a*–*d*. However, other embodiments of receptacles are also within the scope of the invention. Preferably, receptacles 105*a*–*d* each include a ledge (not shown) which positively stops against the bottom edge or a complementary ledge (not shown) at the bottom of inserts 106*a*–*d*. This configuration simplifies alignment of the inserts within the receptacles.

The inserts 106*a*–*d* may be decorative in color or shape, may be aerodynamically shaped, may be shaped to provide acoustic qualities when the head is swung through the air (such as a whistling sound) or to provide acoustic qualities when the head strikes a golf ball, may be of a shape, structure or material that impart particular structural attributes to the golf club head 100, or may be weighted to achieve desired swing characteristics. Preferably, the inserts 106*a*–106*d* are shaped to provide a golf club head with a traditional dome-shaped top, but are light weight, will be aesthetically pleasing and will maximize club head speed due to their aerodynamic characteristics. If the inserts 106*a*–106*d* or any of them are of a transparent or translucent material, such as polycarbonate or acrylic, a logo, design or words may be placed in the head 100 in a receptacle 105*a*–105*d* or on the interior of the insert so that the logo, design or words are visible to a user of the head 100 but are protected from wear by the thickness of the insert 106*a*–106*d*.

FIG. 1 depicts preferred a weight adjustability feature for the golf club head 100. On the outer periphery 102 in the outer periphery wall 102*a*, a weight holder 112, or receptacle, is provided that will receive and hold an insertable weight 111, and preferably one of several insertable weights 111 of different masses. This permits the user to tailor the mass of the golf club head 100 to the mass which provides the best performance for his or her own playing style and ability. In the preferred embodiment of the club head, the weight holder 112 is located at a point on the outer periphery 102 that is both the maximum possible distance from the sweet spot center 110 and that will follow the sweet spot center 110 on an arc through which the head 100 is swung when striking a golf ball. This provides swing and head stability during use and imparts energy to a golf ball upon striking while minimizing the tendency of the golf club head to twist off center.

The weight holder 112 is preferably threaded in a manner which facilitates securing of the weights 111 by screwing insertion into the weight holder. As those of skill in the are will readily appreciate, other mechanisms are also useful for retaining weights 111 within the weight holder 112. A weight 111 could also be retained within the weight holder 112 by other mechanisms, including without limitation, by snapping therein, by use of a resilient material which surrounds the inner surface of the weight holder to engage the weight when placed in the receptacle, by a mechanism which encloses the weight within the receptacle, and others.

Preferably, at least a portion of the weight 111 fits within the receptacle. In the preferred configuration, the weights 111 are threaded complimentarily to the threading of the receptacle 112. Different masses may be achieved by several methods, including, but not limited to, varying the length of the weight 111, the use of heads of various sizes on one end of the weight, the use of materials having different densities, and others.

The structure of the invented golf club head, as described above and elsewhere herein, was chosen for its tendency to provide a club head that is rigid and exhibits minimal distortion and optimizes the distance that a golf ball will fly when struck with the club head. The head design also provides a large sweet spot enabling the user to swing the club head at a golf ball inaccurately and still generate an acceptable golf ball flight.

B. Manufacturing Method

The invented golf club head is preferably made from a fiber-reinforced plastic material by an injection molding process. The most preferred material for use with the present invention is referred to herein as long fiber reinforced thermoplastic.

The long fiber reinforced thermoplastic material described herein is particularly suited for use in fabricating golf club heads because of its three-dimensional strength and three-dimensional stiffness. The long fiber reinforced thermoplastic material is similar to other materials in numerous ways, but is different in characteristics which provide the great advantage of high strength and high stiffness in a plurality of planes/directions.

The long fiber reinforced thermoplastic material used in the present invention is preferably prepared by melting the thermoplastic resin and applying the melted resin to continuous yams of fiber by methods known in the art such a pressurized pultrusion, fluidized bed coating, and wire coating. The plastic-impregnated yarns are then chopped to the desired lengths. Thus, in the long fiber reinforced thermoplastic materials of the present invention, the fibers are generally the same length as the pellet, which in turn, can be cut to any desired length.

In accordance with the present invention, the long fiber reinforced thermoplastic material can preferably be injection molded using an injection molding device having a screw-type injection system. Other molding techniques can also be used in accordance with the present invention. When a screw-type injection system is used, some of the fibers will be broken into segments shorter than those delivered in the pellets. Nevertheless, the preferred material of the present invention has fibers of an average length of at least about four millimeters.

Important to the advantages provided by the present invention is the characteristic that when long fiber reinforced thermoplastic material is injected into a mold, preferably one forming structures having at least a minimum thickness, the long fibers become entangled with each other. Entangled fibers provide increased strength and stiffness in the direction of flow within the mold.

It will be appreciated that the term "entangled," as used herein, means that a portion of the fibers found within the long fiber reinforced thermoplastic material overlap each other to some extent. In some cases, the entanglement may be random and chaotic while in other cases the entanglement may be ordered, or some combination of both.

The preferred plastic component of the long fiber reinforced thermoplastic material is one which is a tough, non-brittle thermoplastic including, without limitation, polyamide, polyurethane, copolyester, polycarbonate, and others. The preferred fiber component of the long fiber reinforced thermoplastic material is a high modulus, high strength, low density fiber such as carbon fiber. The preferred length of the pellets, and hence the length of the fibers in the pellets, is from about 8 mm to about 12 mm. It will be appreciated by those of skill in the art that when injection molding techniques are used, they should be evaluated to make sure that the length of the fibers are maintained as much as possible in order to maintain the advantages of the present invention.

Alternatively, any variety of known reinforcing fibers and plastics, resins and fibers, metals, wood, ceramic or other materials could be used to construct the invented golf club head. The use of fiber-reinforced thermoplastic is preferred for making the invented golf club head due to its ease of manufacture by inexpensive injection molding processes, its durability in the finished product, and its inherent shock absorbing qualities that tend to cause shock and vibration to be absorbed by the club head rather than by the user, thereby contributing to user comfort.

The inserts 106*a–d* are preferably made from a clear, tough, hard material including, but not limited to, plastics such as polycarbonate, structural thermoplastic materials, structural thermoset materials and others. One supplier of polycarbonate is Polymerland, Inc. of Parkersburg, W.Va. In another preferred embodiment, the inserts are made separately from the same material as the club head.

Figure 6:
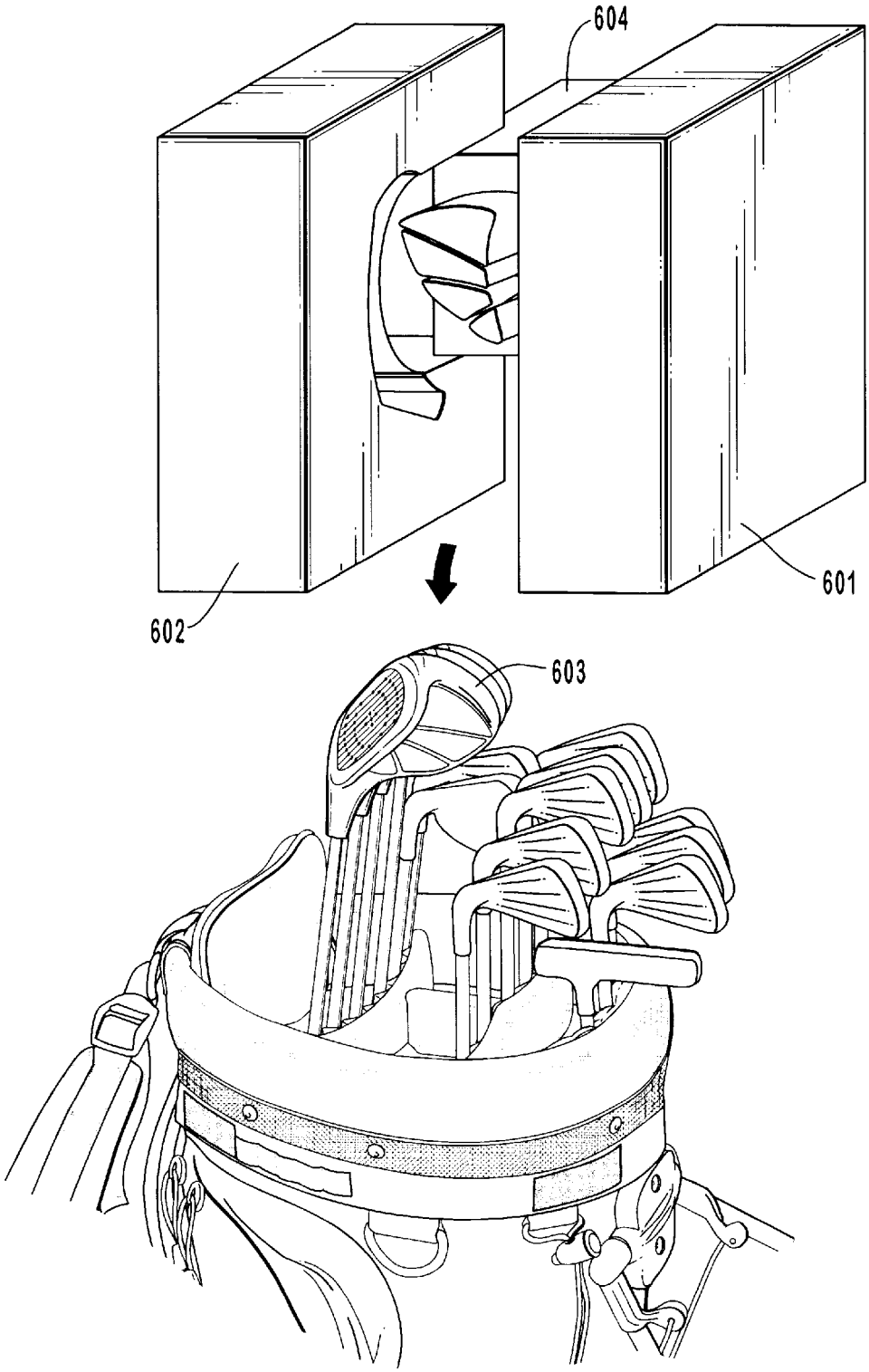
FIG. 6 depicts the invented golf club head being manufactured from fiber-reinforced plastic by an injection molding manufacturing process.

Referring to FIG. 6, two opposing mold halves 601 and 602 are depicted in separated position and from which a finished golf club head 603 has recently fallen. The mold halves 601 and 602 could be installed on any standard injection molding machine commonly available and used to mold the golf club head 603 as described above from fiber-reinforced thermoplastic. The molding environment also includes a sliding core 604 which slides into place when the mold is closed in order to cause the formation of the receptacles 105*a–d* and the power bars 107*a–c* within the body 101 of the club head 100. Typically, an injection molding machine can be run on 30 to 60 second cycles, producing one golf club every cycle if a single cavity mold is used. More heads (such as 2, 4, 8, etc.) can be produced per cycle by using a multi-cavity mold.

The inserts are preferably made by injection molding, and are installed in the receptacles on the golf club head and bonded thereto using an adhesive well known in the art, and which is compatible with the material surrounding the receptacles and with the insert material.

While the present invention has been described and illustrated in conjunction with a number of specific embodiments, those of ordinary skill in the art will appreciate that variations and modifications may be made without departing from the principles of the invention as herein illustrated, described and claimed.

The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed to be secured by a United States Letters Patent is:

1. A golf club head comprising:

a striking face for striking a golf ball, the striking face having a first end and a second end and a proximal side and a distal side, the proximal side of said striking face being adapted for contacting a golf ball, an outer periphery extending from said striking face first end in an outward direction to said striking face second end in order to form a golf club head interior, a body having a top, a solid bottom, a face formed by said striking face, and a heel formed by said outer periphery, a plurality of elongate power bars extending completely from said striking face to said outer periphery, at least one of said elongate power bars extending completely from said body top to said body bottom, a plurality of cavities in said body formed by said power bars, said outer periphery and said striking face, a plurality of hard covers located to cover said cavities, and a combination of resin and reinforcing fibers located in at least one of said striking face, outer periphery and power bars;

wherein said body, said striking face, said outer periphery and said elongate power bars are formed as a single integral piece; and wherein at least two of said cavities are separated by an elongate power bar.

2. A golf club head as in claim 1 wherein said striking face, outer periphery and power bar are made from injection molded fiber-reinforced plastic material.

3. A golf club head as recited in claim 1 wherein an open-topped cavity is formed between said power bar and said outer periphery.

4. A golf club head as recited in claim 3 wherein said cavity contains a filler selected from the group consisting of transparent materials, translucent materials, the material from which the golf club head is made, structural thermoplastic materials and structural themoset materials.

5. A golf club head as recited in claim 4 wherein a design is visible to a user of the golf club head through said filler.

6. A golf club head as recited in claim 4 wherein said filler is aerodynamically shaped.

7. A golf club head as recited in claim 1 wherein said power bars serve to stiffen and reinforce said striking face.

8. A golf club head as recited in claim 1, and further comprising a sole, wherein said sole, said striking face, said outer periphery and said power bar are integrally formed, and wherein the golf club head derives its structural integrity from fiber reinforced plastic material used to integrally form said striking face, said outer periphery, said sole and said power bar.

9. A golf club head as recited in claim 8 wherein said reinforcing fibers are oriented in all three directions in order to provide stiffness in all three directions.

10. A golf club head as recited in claim 1 wherein the golf club head is made from entangled carbon fiber dispersed in thermoplastic.

11. A golf club head as recited in claim 10, and further comprising a sole, wherein said striking face, power bar, outer periphery and sole are formed as a one-piece unitary element by an injection molding manufacturing process.

12. A golf club head as recited in claim 1, and further comprising a sole, wherein said power bar is integral with said outer periphery and said sole to minimize overall golf club head distortion.

13. A golf club head as recited in claim 1, and further comprising a heel at one end and a toe at the other end, wherein said striking face has a sweet spot intended for imparting the greatest possible energy unto a golf ball; and wherein said receptacle in said outer periphery is located a greater distance from said sweet spot than the distance from said sweet spot to the most distant point of said heel or said toe which is capable of accommodating a weight-receiving receptacle.

14. A golf club head as recited in claim 1 wherein said striking face has a sweet spot intended for imparting the greatest possible energy unto a golf ball; and wherein said receptacle in said outer periphery is located at the point on said outer periphery such that during ordinary swing of the golf club head, said sweet spot and said receptacle follow substantially the same swing path.

15. A golf club head as recited in claim 1, wherein the striking face further comprises a location which imparts the greatest energy to a golf ball; and wherein said location and said receptacle follow substantially the same path during an ordinary swing of the golf club head.

16. A golf club head as recited in claim 1, wherein each of said power bars is oriented to reinforce and stiffen said striking face.

17. A golf club head as recited in claim 1 further comprising at least three of said cavities.

18. A golf club head as recited in claim 1 further comprising filler in said at least one of said cavities.

19. A golf club head as recited in claim 1 further comprising a weight in at least one of said cavities.

20. A golf club head as recited in claim 1 wherein said cap is made from a material selected from the group consisting of fiber reinforced plastic, plastic, ceramic, metal and wood.

21. A golf club head as recited in claim 1 wherein said cap is selected from the group consisting of translucent caps, colorless caps and colored caps.

22. A golf club head as recited in claim 1 wherein said cap is made from the same material as said body.

* * * * *